US006428625B1

(12) United States Patent
Colgan et al.

(10) Patent No.: US 6,428,625 B1
(45) Date of Patent: Aug. 6, 2002

(54) PROCESS FOR PICKLING A METAL USING HYDROGEN PEROXIDE

(75) Inventors: Sarah J. Colgan, Warrington; Neil J. Sanders, Merseyside, both of (GB)

(73) Assignee: Solvay (Societe Anonyme) (BE)

( * ) Notice: Subject to any disclaimer, the term of this patent is extended or adjusted under 35 U.S.C. 154(b) by 0 days.

(21) Appl. No.: 09/721,999

(22) Filed: Nov. 27, 2000

Related U.S. Application Data

(62) Division of application No. 09/283,991, filed on Apr. 1, 1999, now Pat. No. 6,210,491.

(30) Foreign Application Priority Data

Apr. 6, 1998 (GB) ..... 9807286

(51) Int. Cl.[7] ..... B08B 3/08; C23G 1/02; C23G 5/032

(52) U.S. Cl. ..... 134/2; 134/3; 134/41; 510/101; 510/375

(58) Field of Search ..... 139/3, 2, 41; 510/101, 510/109, 245, 363, 367, 375, 379, 401

(56) References Cited

U.S. PATENT DOCUMENTS

| | | | | | |
|---|---|---|---|---|---|
| 2,175,160 | A | * | 10/1939 | Zobel et al. | 239/589 |
| 3,491,778 | A | * | 1/1970 | Lehnert et al. | 134/15 |
| 3,864,271 | A | * | 2/1975 | Stalter | 510/254 |
| 4,300,723 | A | * | 11/1981 | Prasthofer | 239/589 |
| 4,389,254 | A | * | 6/1983 | Tusset et al. | 134/3 |
| 5,125,582 | A | * | 6/1992 | Surjaarmadja et al. | 239/589 |
| 5,154,774 | A | | 10/1992 | Bousquet et al. | |
| 5,354,383 | A | * | 10/1994 | Bianchi | 134/3 |
| 5,364,549 | A | * | 11/1994 | McDonogh | 252/79.4 |
| 5,472,515 | A | * | 12/1995 | Roberts et al. | 134/15 |
| 5,690,748 | A | * | 11/1997 | Heriet | 134/3 |
| 5,743,968 | A | * | 4/1998 | Leeker et al. | 134/2 |
| 5,803,981 | A | * | 9/1998 | Lordo | 134/15 |
| 5,843,240 | A | * | 12/1998 | Pedrazini et al. | 134/3 |

FOREIGN PATENT DOCUMENTS

| | | | |
|---|---|---|---|
| EP | 0 188 975 | A | 7/1986 |
| EP | 0 267 166 | A | 5/1988 |
| EP | 0 582 121 | A1 | 2/1994 |
| EP | 0 626 469 | A | 11/1994 |
| EP | 0 776 993 | A1 | 6/1997 |
| EP | 0 792 949 | A | 9/1997 |
| FR | 2 551 465 | | 3/1985 |
| GB | 2 000 196 | | 1/1979 |
| SE | 8305648-1 | | 10/1983 |
| WO | WO 93/04216 | | 3/1993 |
| WO | WO 95/35397 | A | 12/1995 |
| WO | WO 98/15674 | | 4/1998 |

* cited by examiner

*Primary Examiner*—Randy Gulakowkski
*Assistant Examiner*—Saeed T Chaudhry
(74) *Attorney, Agent, or Firm*—Larson & Taylor, PLC

(57) ABSTRACT

In the invention pickling process, steel and nickel or chromium alloys are pickled with an acidic pickling solution employing an oxidant, particularly hydrogen peroxide, and in which liquor is recirculated through inlets comprising a nozzle feeding liquor into a diffuser such that liquor is withdrawn from the bath and the volume of liquor flowing through the diffuser is a multiple of flow through the nozzle.

Steel or the alloys are pickled with an acidic solution containing iron and free hydrogen peroxide at a concentration of up to 0.1 gpl.

The process can operate effectively at a free fluoride concentration of from 20 to 30 gpl and a sulphuric acid concentration of from 80 to 110 gpl.

The lifetime of the bath before it needs to be replaced can be lengthened by the process compared with using an air agitation system.

9 Claims, 1 Drawing Sheet

PROCESS FOR PICKLING A METAL USING HYDROGEN PEROXIDE

This application is a divisional of application Ser. No. 09/283,991, filed Apr. 1, 1999, now U.S. Pat. No. 6,210,491, issued Apr. 3, 2001.

FIELD OF THE INVENTION

This invention concerns a pickling process and in particular a process for pickling employing hydrogen peroxide in aqueous acidic solution.

BACKGROUND OF THE INVENTION

During metal processing, a metal oxide layer is often formed over all or part of the metal surface, impairing its appearance and/or suitability for further processing steps. One example is steel, including particularly stainless steels, where is often desired to produce a product having a bright shiny finish, but the product can often be obtained that is covered wholly or partially with an oxide layer or flakes which impart a dull or blackened appearance. Other examples include nickel and chromium alloys, many of which contain a significant fraction of iron. Accordingly, it is desirable to remove or at least reduce the size and extent of the metal oxide layer. Processes to remove the oxide layer can be described as metal surface cleansing, or in some instances more particularly as metal pickling or polishing or desmutting depending on the specific treatment being carried out. Herein, the term pickling is employed to include all the above variations. In one class of processes, a solution of hydrogen peroxide is employed as oxidant, normally often an aqueous acidic solution to remove the oxide layer.

Steel pickling is normally carried out in an acidic medium. For many years, the preferred acidic medium comprised nitric acid, possibly containing hydrofluoric acid in addition, but during the last 20 years, alternative acid systems have been investigated in order to circumvent environmental problems caused by the emission of NOx from nitric acid—based baths. These alternative acid systems have included sulphuric acid, hydrofluoric acid, hydrochloric acid and mixtures of sulphuric acid with a haloacid such as hydrofluoric acid. In these alternative systems an oxidant is required for the pickling process, and in many instances, hydrogen peroxide has been proposed as that oxidant source. However, it will be understood that although hydrogen peroxide is the primary source of oxidation, the active species that carries out a significant fraction of the pickling treatment is believed to comprise ferric iron with the resultant formation in situ of ferrous iron so that the hydrogen peroxide often serves to oxidise the ferrous iron back to ferric iron species. Operation of the bath also results in further iron being dissolved, either from the oxide layer and/or from the steel surface itself, with consequential increase in iron concentration and eventually the need to replace or regenerate the pickling bath.

A number of publications have described the injection of a stream of air into strongly acid steel pickling baths, either with or without hydrogen peroxide. These publications include French Patent Specification 2 587 369, and European Patent Specifications 0505606 and 0582121. Although the injection or air not only serves to provide an alternative source of oxidant as well as agitating the bath liquor, such a process has a number of significant disadvantages. First, the passage of gas strips acidic and corrosive liquor from the bath, so that it suffers from environmental problems or requires subsequent scrubbing of the gaseous effluent, thereby incurring additional processing steps and cost. As a related consequence, there is a need also to replenish the bath more quickly than if the liquor were not being continually removed from the bath. Secondly, the evaporation of the liquor into the gas cools the bath, thereby increasing the heating costs. Thirdly, and perhaps more surprisingly, the use of an air stream tends to shorten the life of the bath before it needs to be replaced. That is because air bubbles in the stream have a tendency to lodge underneath the flakes of oxide, and as they expand they exert pressure on the flakes, separating them from the metal surface. Whilst it is an objective of a pickling process to remove the oxide layer, it is disadvantageous for too high a proportion to be removed within the pickling bath itself because the bath life is shortened. Instead, it would be advantageous for the flakes to remain adhering to the metal surface to a greater extent during the pickling process, but be dislodged during a subsequent high pressure washing process.

In Swedish Patent Application 8305648-1, there is disclosed an improvement compared with using an air stream, namely a process for reducing the extent of off-gas removal from an acidic pickling bath and particularly for pickling stainless steel, by recirculating the bath liquor through a recirculation line and injecting hydrogen peroxide into the line so that it is introduced into the bath through sprinklers perforated pipes or nozzles placed at the bottom of the bath. The bath acids disclosed therein comprise sulphuric acid, or nitric acid or nitric/hydrofluoric acid. The same system is described in European Patent Application 776 993, though with the additional recognition that liquors used to pickle steel contain iron, which any expert recognises to be inevitable.

The aforementioned French Patent Application 2587369 European Patent 505606 and Application 582121 and British Patent Specification 2000196 all describe a process for steel pickling employing hydrogen peroxide as oxidant in which the introduction of hydrogen peroxide is controlled by the redox measurement of the bath to maintain a desired electropotential. This is an appropriate technique to adopt when the bath liquor contains and is intended to retain a substantial fraction of dissolved iron as ferrous species. However, since it is the ferric iron which the predominant active pickling species, such a process lessens the rate at which pickling can take place.

It is an object of certain aspects of the present invention to provide an improvement or alternative to the processes described hereinbefore.

According to first aspect of the present invention, there is provided a process for pickling steel or a nickel or chromium alloy in an aqueous acidic pickling bath in which the steel is brought into contact with a pickling solution that is continuously being withdrawn from the bath and returned into bath under pressure through one or more inlets located underneath the surface of the bath characterised in that the inlet comprises a nozzle pointing towards the mouth of a tubular diffuser, the mouth having an internal diameter greater than the internal diameter of the nozzle and a body having a narrower internal diameter than its mouth, whereby, in operation, liquor flowing under pressure through the nozzle into the diffuser sucks bath liquor through the mouth of the diffuser and flows through the diffuser in a co-current direction.

In such a process, the benefits are retained of employing a recirculating liquor instead of an external air stream being introduced, but in addition, there is significantly improved mixing compared with the simple recirculating systems described and contemplated by Swedish Patent Application 8305648-1 and European Patent Application 776 993. The presence of the diffuser enables the flow from the nozzle to mix with liquor which is already present in the bath to produce a greater volume of liquor that is mixed in a controlled fashion.

By selecting a suitable ratio of the diameter of the mouth to the diameter of the nozzle in conjunction with the linear flow rate of liquor through the nozzle, it is possible to vary the ratio of flow of liquor from the nozzle and liquor sucked into the diffuser from the bath. In many instances the ratio of flows fall within the range of 1:1 to 10:1 and particularly from 2.5:1 to 5:1 for the flow sucked into the dispenser compared with the flow that is pressurised out through the nozzle. It is convenient for the present invention to select a diameter ratio of mouth to nozzle in the range of 3:1 to 20:1, and in many instances from 5:1 to 10:1. The internal diameter of the diffuser at its narrowest can be significantly narrower than at its mouth, but is intermediate between that of the nozzle and the mouth. The narrowest diameter of the diffuser is often wider than the nozzle diameter by between 15 to 50% of the difference between the nozzle and mouth diameters. In a convenient arrangement, the ratio of the diameters of diffuser mouth to nozzle and diffuser waist to nozzle is respectively 7:1 and 3:1. Where the nozzle, mouth or body of the diffuser not regular, an average value is preferably employed.

The diffuser may advantageously be waisted, ie widen out after its narrowest diameter (its waist) such that at its outlet its internal diameter is close to that of its mouth, such as +/−20%.

The length of the diffuser tube is often between 1 to 2.5 times the diameter of its mouth, such as about 1.5 to 2 times. The diffuser tube advantageously is substantially co-axial with the nozzle. Although it would be possible for the diffuser tube to be separate from the nozzle, and still be located in the appropriate relative positions, it is more convenient if the nozzle is attached to the diffuser tube, for example by two or more fingers attached at one end to the mouth and at the other end to the nozzle. It is beneficial if the tip of the nozzle is close to or position within the mouth of the diffuser tube. Liquor is able to flow between the fingers into the mouth.

It is highly desirable to make those parts of the liquor recirculation system, such as distribution lines and the inlet units that are located within the bath from materials that are resistant to attack from strong mineral acids. Such materials include polypropylene, and particularly when it has been reinforced by glass.

The liquor in the recirculation system is normally pumped. The use of the invention system enables a pump of lower power to be employed whilst still obtaining the benefits of excellent control of the bath.

It is desirable to control the recirculation to provide between 0.5 and 10 bath changes per hour, and particularly between 1.5 and 3 bath changes per hour. The number of nozzle/diffuser units installed in each bath preferably is matched to the volume of the bath. It is desirable to install 1 unit for each 300 to 800 litres of bath volume, and preferably per 400 to 600 litres. Each unit is dimensioned desirably to dispense from 10 to 40 litres of recirculated liquor per minute into the bath, and preferably from 15 to 25 litres per minute. Since the units often suck about 3 to 6 times that volume through the diffuser in addition to the volume pumped through the nozzle, it means that each unit is often distributing between 50 and 125 litres per minute.

By suitable dimensioning the diameters of the nozzle relative to the pump pressure in the recirculation line, it is possible to control the linear rate of flow of the liquor into the pickling bath. It is desirable to employ a linear flow rate of between 1.5 to 5 $Ms^{-1}$, and particularly from 2 to 3 $Ms^{-1}$.

The use of a diffuser enables the combined flow to be controlled in a desired direction and to provide a well mixed liquor quickly. The recirculation liquor can be directed towards the steel workpiece, thereby not only combining the virtues of excellent mixing of the liquor to ensure an even temperature and composition throughout the bath, but also enabling the workpiece to face constantly refreshed liquor. The invention enables the even bath composition to be achieved at a controlled gentle flow of recirculation liquor, that is to say that its linear velocity does not remove the adhering flakes of oxide layer from the steel at the same rate as is observable when employing a stream of air to agitate the bath. This means that although in the invention process, the contact between the oxide layer and the steel surface is loosened, a substantial fraction of the layer remains on the steel until it is subjected to a subsequent pressure washing process. In that way the life of the bath is enhanced.

The difference in flow patterns between the invention process and an air agitated bath is observable by looking at the baths. That of the instant invention presents a smooth surface, whereas when air agitation is employed, its bath surface is constantly disturbed by bursting bubbles.

The invention process is particularly applicable to use in oxidising acidic baths, such as especially baths containing sulphuric and/or hydrofluoric acid, and especially baths containing both. In such baths, when used to pickle steel, there are normally iron species in solution at a concentration selected in the range of from 15 to 120 gpl, calculate as Fe, and preferably up to 100 gpl, of which ferric species preferably constitute at least 15 gpl, calculated as Fe.

The speed of pickling of the steel varies with the ferric concentration in solution. It is at its fastest in the region of about 40 to 60 gpl. calculated as Fe. In some methods of operating, it is suitable to maintain the bath within that range by continuously or intermittently withdrawing a small fraction of the bath liquor and replacing it with fresh liquor sulphuric acid and hydrofluoric acid at their selected concentrations, such replacement liquor containing a lower concentration of iron in solution or preferably no iron at all. This can be achieved alternatively by treating liquor withdrawn from the bath to remove iron salts, for example using commercially available apparatus for ion removal. This is of particular benefit in the present invention because it generates sludge at only a slow rate compared for example with air-agitated pickling systems, so that a rapid pickling rate can be combined with a prolonged bath life.

The ratio of ferric to ferrous species in the pickling process is, to some extent, at the discretion of the process operator. However, it is particularly desirable to operate at a low or non-existent ferrous iron content in solution, because by so doing it optimises the effectiveness of the iron in solution to conduct the pickling. Oxidation of the ferrous to ferric species in solution in the instant invention is most conveniently carried out using hydrogen peroxide. In a particularly preferred way of operating, sufficient hydrogen peroxide is introduced to leave a detectable measurable concentration of hydrogen peroxide, particularly of not more than 0.1 gpl and especially from 0.01 to 0.05 gpl. Monitoring can be conducted by regular withdrawal of samples of bath liquor and titration in standard methods for hydrogen peroxide. By maintaining such a low concentration of hydrogen peroxide, it is possible to obtain the benefits of rapid pickling when all the iron in solution is present as ferric species, whilst avoiding excessive losses of hydrogen peroxide that would arise if a high concentration of peroxide, such as 1 gpl or higher were maintained.

Thus, in a second aspect of the present invention there is provide a process for pickling steel or a nickel or chromium alloy in an aqueous acidic pickling bath in which the steel is brought into contact with a pickling solution containing dissolved iron characterised in that the solution contains detectable hydrogen peroxide at a concentration of no more than 0.1 gpl.

The second aspect of the present invention can be employed simultaneously with the use of the first aspect. The hydrogen peroxide can be introduced into the bath at any point conveniently selected by the operator. It can also be introduced into the recycle system of the first aspect.

The concentration of sulphuric acid in the process is normally at the discretion of the process operator. It is desirable to employ a sulphuric acid concentration of at least 50 gpl and it is possible to employ a concentration in excess of 150 gpl, such as up to 300 g/l, but it has been found that in the invention process it is possible to operate effectively at a concentration of below 150 gpl. In a number of satisfactory embodiments of the present invention, the sulphuric acid concentration is at least 60 gpl up to 120 gpl and particularly selected and advantageously is maintained within the range of 80 to 100 gpl.

The pickling bath advantageously contains free fluoride, calculated as HF, at a concentration of least 10 gpl, and often not greater than 40 gpl. By free fluoride is meant fluoride that is not complexed with iron. The concentration of complexed fluoride will naturally vary as the concentration of iron varies. By the use of the present process, and especially when operating in accordance with the second aspect of the invention, it is often convenient at operate at a free fluoride concentration of from 20 to 30 gpl as HF, when the solution contains all its soluble iron as ferric species.

The hydrogen peroxide employed in the present invention process is advantageously stabilised in order to reduce its rate of consumption by decomposition. The choice of stabiliser is at the discretion of the operator. Suitable stabilisers include p-hydroxybenzoic acid and phenacetin. It is especially advantageous to employ a hydrogen peroxide solution which contains appropriate stabilisers for effective operation within a steel pickling bath. A preferred solution comprises a 25 to 50% w/w hydrogen peroxide solution containing a stabiliser system at a concentration of from 3 to 10 g/l, the stabiliser system comprising a) from 80 to 200 parts and preferably 100 to 150 parts by weight of a hydroxybenzoic acid, and preferably p-hydroxybenzoic acid
b) from 50 to 120 parts and preferably from 60 to 100 parts by weight of a hydrotropic aryl sulphonic acid, and preferably p-toluenesulphonic acid
c) from 2.5 to 6 parts and preferably from 3 to 5 parts by weight of a hydrophobic alkaryl sulphonic acid and preferably docdecyl benzene sulphonic acid.

The hydrogen peroxide solution can be employed at its natural pH, or be partially neutralised, for example to within the pH range of 3.5 to 4.0.

The invention process can be employed to pickle with a wide range of steels, including ferritic, austenitic, martensitic, and duplex. The steel workpiece can adopt a range of different forms, including wire, tube and plate. It will be recognised that the severity and duration of pickling are often chosen in accordance with the type and nature of the workpiece. For example, the least severe and shortest pickling treatments are often employed for ferritic steel, whereas the most severe and longest treatments are often selected for treating duplex steel.

Although the invention process has been described directly in relation to the surface treatment of steel, it can likewise be employed mutatis mutandis for the surface treatment of nickel-iron, nickel-chromium alloys and chromium-iron alloys. It will be recognised that like steel, such alloys can also contain minor fractions of other elements such as other transition metals.

The pickling process is often conducted at a temperature selected in the range of from 10 to 60° C., especially at above 20° C. and in many instances from 35 to 55° C.

The present invention can be employed for both continuous operation and batch processing. For batch processing, the workpiece is lowered into the pickling bath, immersed for a selected period of time and subsequently withdrawn. It is then subjected to a water wash, normally conducted using a high pressure jet. Inspection of the workpiece indicates whether it has been pickled to a sufficient extent. Either by plan or as a result of the inspection, the workpiece can be returned to the pickling bath or a finishing bath for a further treatment. Particularly for wire, a second pickle is desirable, in order to contact wire surfaces that were not properly exposed in the first pickle. Pickling times vary taking into account other conditions such as temperature and ferric iron concentration, and the nature/type of workpiece. They are often selected within the range of from 2 to 60 minutes, and in many instances in batch processing are between 10 and 30 minutes.

It is of practical importance to position the recirculation nozzles suitably relative to the steel workpiece. A height of about 20 to 40 cms above the floor of the bath and pointing towards the workpiece is often preferred, since it is above the slurry that builds up on the bath floor. For example, it is advantageous to site the nozzles pointing towards and along the axis of the tubes, thereby enabling the liquor to flow through and pickle the inside of the tubes, as well as the outside. This can be achieved with a horizontal bath. It will be recognised that this is not practical for an air-agitated bath.

Having described the invention in general terms, specific embodiments thereof are described in greater detail by way of example only, and in conjunction with the appended Figures.

DETAILED DESCRIPTION

Example 1

Figure 1:
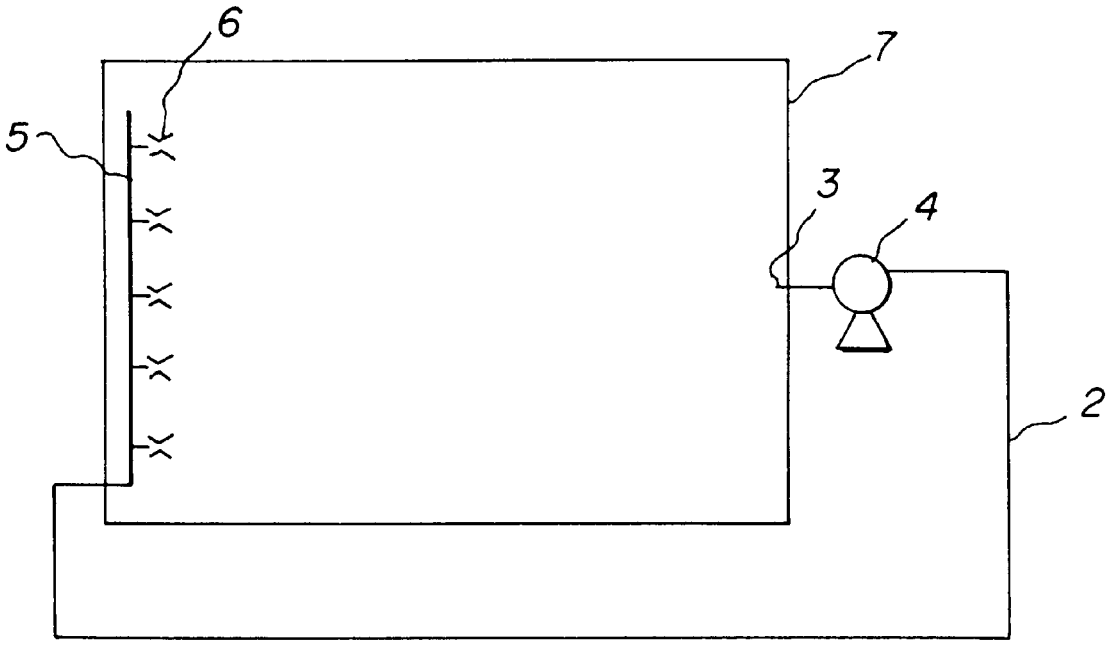
FIG. 1 shows a schematic plan view of a pickling bath (1) having a recirculating pipe (2) leading from an outlet (3) through a pump (4) to a distribution pipe (5) located about 30 cms above the floor of the bath and fitted with five inlets (6). In operation, liquor is withdrawn through outlet (2), and pumped through distribution pipe (5) and inlets (6) into contact with a workpiece (not illustrated) in the bath (1).
Figure 2:
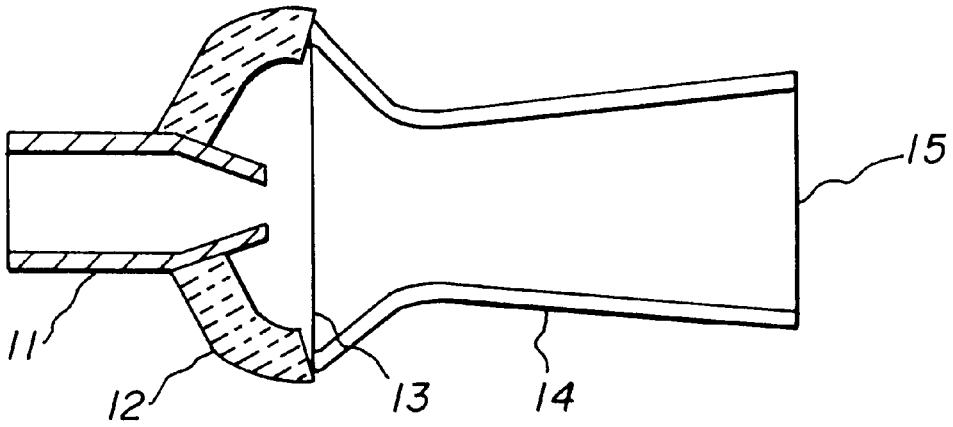
FIG. 2 shows a cross-sectional view of one inlet (6) which consists of a tapered nozzle (11) attached through fingers (12) to the mouth (13) of a diffuser tube (14). The diffuser tube (14) is waisted sharply from its mouth (13) and more gently from its outlet (15). In operation, liquor is pumped through the nozzle (11) into the diffuser tube (14) and additional liquor is sucked into the mouth of the diffuser tube (14) from the surrounding liquor in the bath, and flows out of the diffuser (14) through its outlet (15).

In this Example a pickle bath containing a recirculation line in accordance with FIGS. 1 and 2 was employed. The bath of about 7000 litres contained sulphuric acid at a concentration of 100 gpl, ferric iron at a concentration of 15 gpl as Fe obtained from the oxidation of ferrous sulphate with aqueous hydrogen peroxide, hydrofluoric acid providing a free fluoride concentration of 30 pgl calculated as HF and hydrogen peroxide at a concentration of 0.05 gpl as $H_2O_2$. The bath was employed for batch pickling and analysed periodically for its constituents. When the sulphuric acid concentration had fallen to about 80 gpl sulphuric acid its concentration was restored to about 110 gpl. When the concentration of free fluoride had fallen to about 20 gpl, its concentration was restored to between 30 and 35 gpl.

The hydrogen peroxide concentration was determined by withdrawing a known volume of sample, 10 mls, adding it together with a known volume of ferrous sulphate solution, 20 mls, to 100 mls water, and titrating against a standardised potassium permanganate solution to a permanent pink colour. The result (a) is compared against a bland (B) in which the sample is omitted. When B>A, hydrogen peroxide is present in the sample and its concentration in gpl is given by the formula (B-A)*N*1.7 in which N is the normality of the ferrous sulphate solution.

The bath was maintained at a positive hydrogen peroxide concentration in the region of 0.01 to 0.05 gpl by the introduction of aqueous hydrogen peroxide solution (20 l/hr, 31.4% w/w $H_2O_2$, containing p-hydroxybenzoic acid, 1.7 gpl, p-toluenesulphonic acid, 1.8 gpl, and dodecylbenzenesulphonic acid, 0.09 gpl) which pickling was being carried out.

The bath was recycled at approximately 2 bath volumes per hour through inlet units, at a linear velocity of about 2.7 $Ms^{-1}$ and a volume flow through the unit's diffuser of about 5 times the volume flow through its nozzle. The diameter of the nozzle was approximately $1/11^{th}$ the diameter of the diffuser mouth and $1/3^{rd}$ the diameter of the diffuser at its narrowest point.

The bath was maintained at a bath temperature of 47° C. The workpiece was pickled by immersing it in the bath for 25 minutes, rinsing with a high pressure water wash, immersing again for 20 minutes and giving it a second high pressure wash.

The grades of steel pickled were 304, 316, 321 and 18/8. A range of shapes, square, hexagonal, round and tee shaped as well as 3.75 mm 5.5 mm and to 10 mm wire were pickled.

Visual assessment of the treated workpieces showed that the process had effectively removed the oxide layer to generate a bright shiny surface.

It was observed that the rate of deposit of slurry on the floor of the bath was comparatively slow relative to the surface area of workpieces being processed.

Example 2

In this Example, the procedure of Example 1 was followed except that in this Example, the bath temperature varied between 47 and 53° C. and the pickling time was varied depending on the grade of steel being pickled. The rate of hydrogen peroxide addition was varied at between 17 and 22 l/hr to maintain the hydrogen peroxide concentration in the bath in or close to the range of 0.01 to 0.05 gpl $H_2O_2$.

Grades 302 and 304 were each pickled in two stages at 15 minutes and 10 minutes; 321 grade was pickled for 20 minutes and 10 minutes; 308 grade was pickled in three stages at 20, 10 and 10 minutes.

Visual assessment showed that after the workpieces had been washed after the final pickling stage, they were clean and bright.

What is claimed is:

1. A process for pickling a metal selected from the group consisting of steel, nickel alloy and chromium alloy in an aqueous acidic pickling bath comprising contacting the metal with a pickling solution containing dissolved iron, the solution containing detectable hydrogen peroxide at a concentration from 0.01 to no more than 0.1 gpl.

2. The process according to claim 1, further comprising monitoring hydrogen peroxide concentration by periodically withdrawing samples and analysing said samples by titration.

3. The process according to claim 2, further comprising controlling flow rate of hydrogen peroxide into the pickling bath on the basis of the analysis, in order to bring the hydrogen peroxide concentration into or keep it within the range of 0.01 to 0.05 gpl.

4. The process according to claim 1, wherein the pickling bath comprises sulphuric acid at a concentration of from 80 to 110 gpl, hydrofluoric acid providing free fluoride at a concentration of from 20 to 30 gpl calculated as HF and 15 to 120 gpl iron species calculated as Fe, of which ferric species constitute at least 15 gpl as Fe.

5. The process according to claim 4, wherein the solution is maintained at a ferric iron concentration as Fe of from 40 to 60 gpl.

6. The process according to claim 1, wherein the hydrogen peroxide solution introduced into the bath is stabilised with a stabiliser system at a concentration of 3 to 10 gpl comprising:

a) from 80 to 200 parts by weight of a hydroxybenzoic acid, b) from 50 to 120 parts by weight of a hydrotropic aryl sulphonic acid, and c) from 2.5 to 6 parts by weight of a hydrophobic alkaryl sulphonic acid.

7. The process according to claim 6 wherein the stabiliser system comprises:

a) 100 to 150 parts by weight of the hydroxybenzoic acid;

b) 60 to 100 parts by weight of a hydrotropic aryl sulphonic acid, and c) 3 to 5 parts by weight of a hydrophobic alkaryl sulphonic acid.

8. The process according to claim 6 wherein the hydroxybenzoic acid comprises p-hydroxybenzoic acid, the hydrotropic aryl sulphonic acid comprises p-toluenesulphonic acid, and the hydrophobic alkaryl sulphonic acid comprises dodecyl benzene sulphonic acid.

9. The process according to claim 1, conducted in the absence of an air agitation system.

* * * * *